US007951280B2

(12) United States Patent
Wang et al.

(10) Patent No.: US 7,951,280 B2
(45) Date of Patent: May 31, 2011

(54) GALLIUM ELECTROPLATING METHODS AND ELECTROLYTES EMPLOYING MIXED SOLVENTS

(75) Inventors: Jiaxiong Wang, Castro Valley, CA (US); Serdar Aksu, Milpitas, CA (US); Bulent M. Basol, Manhattan Beach, CA (US)

(73) Assignee: SoloPower, Inc., San Jose, CA (US)

( * ) Notice: Subject to any disclaimer, the term of this patent is extended or adjusted under 35 U.S.C. 154(b) by 0 days.

(21) Appl. No.: 12/267,488

(22) Filed: Nov. 7, 2008

(65) Prior Publication Data

US 2010/0116678 A1 May 13, 2010

(51) Int. Cl.

| | |
|---|---|
| ***C25D 3/00*** | (2006.01) |
| ***C25D 5/10*** | (2006.01) |
| ***C23C 28/02*** | (2006.01) |
| ***C23C 28/00*** | (2006.01) |
| ***C23C 16/40*** | (2006.01) |

(52) U.S. Cl. ..... 205/261; 205/170; 205/182; 205/184; 205/191; 106/1.25

(58) Field of Classification Search ..... 106/1.25; 205/261, 170, 182, 184, 191
See application file for complete search history.

(56) References Cited

U.S. PATENT DOCUMENTS

| | | | | |
|---|---|---|---|---|
| 2,931,758 | A | 4/1960 | Zimmerman et al. | 204/14 |
| 4,709,122 | A * | 11/1987 | Samuels | 174/50.5 |
| 7,297,868 | B2 * | 11/2007 | Bhattacharya | 136/262 |
| 2007/0272558 | A1 | 11/2007 | Aksu et al. | 205/239 |

FOREIGN PATENT DOCUMENTS

SU 264095 A * 12/1968

OTHER PUBLICATIONS

Tataev et al., "Effect of Organic Alcohols on the Deposition of Indium and Gallium on a Solid Electrode", Primen. Org. Reagentov Anal. Khim. (no motnh, 1974), pp. 137-140. 1-Page Abstract Only.*
Flamini et al., "Electrodeposition of Gallium onto Vitreous Carbon", J. Appl. Electrochem. (no month, 2007), vol. 37, pp. 467-471.*

(Continued)

*Primary Examiner* — Edna Wong
(74) *Attorney, Agent, or Firm* — Pillsbury WInthrop Shaw Pittman LLP

(57) ABSTRACT

An electrochemical deposition method and electrolyte to plate uniform, defect free and smooth gallium films are provided. In a preferred embodiment, the electrolyte may include a solvent that comprises water and at least one monohydroxyl alcohol, a gallium salt, and an acid to control the solution pH and conductivity. The method electrodeposits a gallium film possessing sub-micron thickness on a conductive surface. Such gallium layers are used in fabrication of semiconductor and electronic devices such as thin film solar cells.

18 Claims, 1 Drawing Sheet

OTHER PUBLICATIONS

Lincot et al., "Chalcopyrite Thin Film Solar Cells by Electrodeposition", Solar Energy (no month, 2004), vol. 77, pp. 725-737.*

Tataev et al., "Effect of Organic Alcohols on the Deposition of Indium and Gallium on a Solid Electrode", Primen. Org. Reagentov Anal. Khim. (no month, 1974), pp. 137-140. Full Document.*

Flamini et al., "Electrodeposition of Gallium onto Vitreous Carbon", J. Appl. Electrochem. (no month, 2007), vol. 37, pp. 467-471.*

Lincot et al., "Chalcopyrite Thin Film Solar Cells by Electrodeposition", Solar Energy (no month, 2004), vol. 77, pp. 725-737.*

Sundararajan et al., "The Electrodeposition of Gallium From a Chloride Bath", J. Less-Common Metals, vol. 11 (no month, 1996), pp. 360-364.*

Andreoli, P., et al., "Electrochemical Approaches to GaAs1-xSbX Thin Films", *J. of Electroanaly. Chem.*, vol. 385, pp. 265-268, (1995).

Bockris, et al., "Electrodeposion of Gallium on Liquid and Solid Gallium Electrodes in Alkaline Solutions", *J. Electrochem. Soc.*, vol. 109, p. 48-54, 1962.

Mehlin, et al., "Preparation of CuGaSe2 Thin Film solar Cells Comprising an Electrochemical Gallium Deposition Step", *Z. Naturforsch*, vol. 49b, pp. 1597-1605, 1994.

Sundararajan, S., et al., "The Electrodeposition of Gallium from a Chloride Bath", *J. Less Common Metals*, vol. 11, pp. 360-364 (1966).

* cited by examiner

GALLIUM ELECTROPLATING METHODS AND ELECTROLYTES EMPLOYING MIXED SOLVENTS

BACKGROUND

1. Field of the Inventions

Embodiments of the present invention relate to thin film gallium (Ga) electroplating methods and chemistries employing electrolytes or solutions comprising mixtures of water and certain classes of organic liquids. Such films have application in the field of electronic devices such as solar cells.

2. Description of the Related Art

Thin film solar cells have attracted much attention lately because of their potential low cost. Thin film solar cells may employ, as their light absorbing layer or absorber, polycrystalline silicon, amorphous silicon, cadmium telluride (CdTe), copper indium gallium selenide (sulfide) (CIGS(S)), etc. The processing methods used for the preparation of thin film solar cell absorber layers can generally be classified as dry and wet processes. The dry processes include physical vapor deposition (PVD) and chemical vapor deposition (CVD) techniques, which are usually well developed, however, expensive. Wet processes include ink spraying or printing, chemical bath deposition (CBD) and electrochemical deposition (ED), also called electrodeposition or electroplating. Among these methods, CBD is popular for the preparation of some n-type semiconductor films like CdS, ZnSe, In—Se, etc. In ink deposition processes, inks comprising nano-particles dispersed in a solvent are deposited on a substrate. When the solvent evaporates away, it leaves behind a precursor layer comprising the nano-particles. The precursor layer is then sintered at high temperatures to form the absorber.

Electrochemical deposition techniques can provide thin precursor films which may then be converted into solar cell absorbers. One recent application of electroplated copper (Cu), indium (In) and gallium (Ga) films is in the formation of $Cu(In,Ga)(Se,S)_2$ or CIGS(S) type layers, which are the most advanced compound absorbers for polycrystalline thin film solar cells. It should be noted that the notation (In, Ga) means all compositions from 100% In and 0% Ga to 0% In and 100% Ga. Similarly, (Se,S) means all compositions from 100% Se and 0% S to 0% Se and 100% S. Applying electrodeposition to the formation of a CIGS(S) type absorber layer may involve a two-stage or two-step processing approach comprising a precursor deposition step and a reaction step. A thin In layer, for example, may be electroplated on a Cu layer. A thin Ga film may then be formed on the In layer to form a Cu/In/Ga stack precursor. The Cu/In/Ga precursor stack thus obtained may then be reacted with selenium (Se) to form a CIGS absorber. Further reaction with sulfur (S) would form a CIGS(S) layer. The CIGS(S) absorber may be used in the fabrication of thin film solar cells with a structure of "contact/CIGS(S)/buffer layer/TCO", where the contact is a metallic layer such as a molybdenum (Mo) layer, the buffer layer is a thin transparent film such as a cadmium sulfide (CdS) film and transparent conductive oxide (TCO) is a transparent conductive layer such as a zinc oxide (ZnO) and/or an indium tin oxide (ITO) layer.

In a thin film solar cell employing a Group IBIIIAVIA compound absorber such as CIGS(S), the cell efficiency is a strong function of the molar ratio of IB/IIIA. If there are more than one Group IIIA materials in the composition, the relative amounts or molar ratios of these IIIA elements also affect the properties. For a $Cu(In,Ga)(S,Se)_2$ or CIGS(S) absorber layer, for example, the efficiency of the device is a function of the molar ratio of Cu/(In+Ga), where Cu is the Group IB element and Ga and In are the Group IIIA elements. Furthermore, some of the important parameters of the cell, such as its open circuit voltage, short circuit current and fill factor vary with the molar ratio of the IIIA elements, i.e. the Ga/(Ga+In) molar ratio. In general, for good device performance Cu/(In+Ga) molar ratio is kept at or below 1.0. For ratios close to or higher than 1.0, a low resistance copper selenide phase may form, which may introduce electrical shorts within the solar cells. As the Ga/(Ga+In) molar ratio increases, on the other hand, the optical bandgap of the absorber layer increases and therefore the open circuit voltage of the solar cell increases while the short circuit current typically may decrease. It is important for a thin film deposition process to have the capability of controlling both the molar ratio of IB/IIIA, and the molar ratios of the Group IIIA components in the composition. Therefore, if electrodeposition is used to introduce the Ga into the film composition, it is essential that the electroplated Ga films have smooth morphology and be free of defects such as pinholes. It should be noted that the typical thickness of Ga layers to be electroplated for CIGS(S) absorber formation is in the range of 50-300 nm and many prior art electroplated Ga layers display a peak-to-valley surface roughness in the range of 50-500 nm, which means that these films are very thick in some areas and very thin in others.

In an application of electroplated Ga layers to solar cell fabrication, the Ga layer may be electroplated to form precursor stacks with structures such as Cu/In/Ga, Cu/Ga/In, etc. These stacks may then be reacted at high temperature (typically in the range of 400-600° C.) with a Group VIA material such as Se and S to form a CIGS(S) absorber layer. The absorber layer may then be further processed to construct a solar cell. US Patent Application with publication No. 20070272558, entitled "Efficient Gallium Thin Film Electroplating Methods and Chemistries" filed by the applicants of this application and incorporated herein by reference, discloses new methods and chemistries to deposit Ga films with high plating efficiency. Other work on electrodeposition of Ga includes the publication by S. Sundararajan and T. Bhat (J. Less Common Metals, vol. 11, p. 360, 1966) who utilized electrolytes with a pH value varying between 0 and 5. Other researchers investigated Ga deposition out of high pH solutions comprising water and/or glycerol. Bockris and Enyo, for example, used an alkaline electrolyte containing Ga-chloride and NaOH (J. Electrochemical Society, vol. 109, p. 48, 1962), whereas, P. Andreoli et al. (Journal of Electroanalytical Chemistry, vol. 385, page. 265, 1995) studied an electrolyte comprising KOH and Ga-chloride. While some of these previous works used very corrosive solutions, i.e., pH-15, most of them were carried out under low plating efficiencies in low pH electrolytes, the plating efficiencies being typically 20% or lower. Glycerol, due to its high boiling temperature has also been used in high temperature (>100° C.) preparation of electrodeposition chemistries to plate molten globules of Ga—In alloys (see e.g. U.S. Pat. No. 2,931,758). Although, glycerol-based plating solutions may be adequate to obtain Ga deposits in the form of thick molten globules such deposits cannot be used in the formation solar cell absorbers such as thin film CIGS(S) compounds. From the foregoing, there is a need to develop Ga electrolytes and electrodeposition methods to generate smooth, uniform and defect-free Ga thin films with high plating efficiencies on surfaces of varying chemical composition. This way Ga layers may be electroplated onto different cathode surfaces for electronics applications, specifically for the fabrication of high quality CIGS(S) type thin film solar cell absorbers.

SUMMARY

An aspect of embodiments of the present invention is to provide an electrodeposition solution for depositing a gallium (Ga) thin film on a conductive surface. The electrodeposition solution includes a solvent including an organic solution, such as a mixture of at least one monohydroxyl alcohol and water and a Ga source. The electrodeposition solution further includes at least one of an acid and a salt for controlling the solution pH value and providing a high ionic conductivity in the plating solution. This solution can be used to plate Ga at a very low temperature.

Another aspect of embodiments of the present invention is to provide a method of electrodepositing a Ga thin film on a conductive surface. The method includes the steps of providing an electrodeposition solution that includes a mixture of at least one monohydroxyl alcohol and an aqueous solvent; a Ga source, and at least one of an acid and a salt to control the solution pH value and provide a good conductivity for plating; adjusting the pH of the electrodeposition solution between 0 and 7, preferably between 1 and 3; contacting the solution with an anode and the conductive surface; establishing a potential difference between the anode and the conductive surface; and electrodepositing the Ga thin film on the conductive surface. The freezing point of the electrodeposition solution can be significantly lower than that of water, and thus the electrodeposition solution of the present invention can be used at low temperatures to prevent Ga melting and alloying with the underlying materials and to obtain films with improved amounts of surface roughness.

DETAILED DESCRIPTION OF THE PREFERRED EMBODIMENTS

Figure 1:
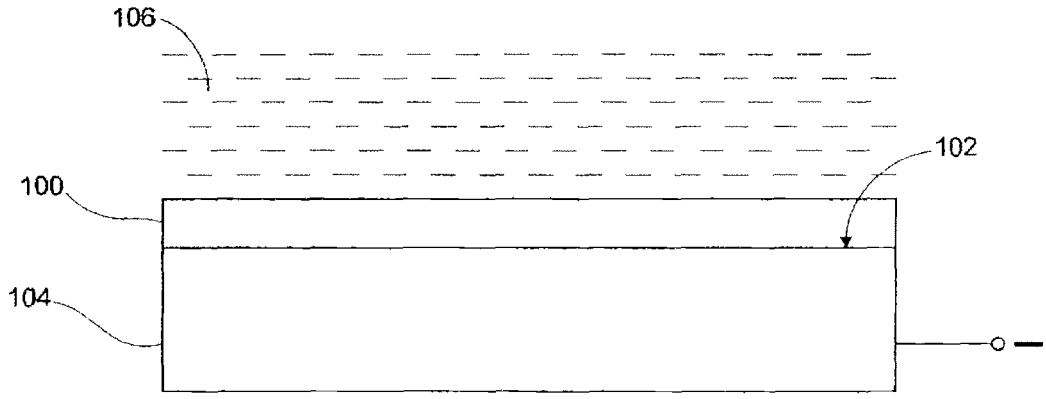
FIG. 1 is a schematic illustration of a gallium film electrodeposited on a conductive surface from an electrodeposition solution.

The embodiments of the present inventions provide methods and electrodeposition solutions or electrolytes to electrodeposit uniform, smooth and repeatable gallium (Ga) films. Through the use of various aspects of the present inventions it is possible to form micron or sub-micron thick Ga films on conductive surfaces from solutions mixed with aqueous and organic solvents such as alcohols. The present inventions may be used to form gallium films for manufacturing solar cell absorbers. Electrodeposition solutions of the embodiments of the present inventions may be used at very low temperatures to improve the surface morphology of electroplated Ga films.

FIG. 1 shows an exemplary gallium thin film 100 or layer electrodeposited on a surface 102 of a conductive layer 104 from an electrodeposition solution 106 using an electrodeposition method. The gallium thin film 100 may be a part of a precursor stack, which may include indium and copper layers. The conductive layer 104 may be a solar cell base comprising a substrate and a contact layer deposited on the substrate, or a precursor layer including at least one of a gallium layer, indium layer and copper layer formed on the base. During the electrodeposition process, the conductive layer 104 is brought into contact with the electrodeposition solution 106 and negatively polarized with respect to a positively polarized electrode (not shown) that is also in contact with the electrodeposition solution. A typical conductive layer 104 used by embodiments of the inventions comprise at least one of Cu, Ga, In, Mo, Ru, Ir and Os.

Gallium electrodeposition electrolytes and electrodeposition methods for solar cell manufacturing processes have many more stringent and special requirements than the electrodeposition methods and solutions employed for many other commonly plated metals such as Cu, Ni, Co, Pb, Sn, Ag, Au, Pt, and their alloys, etc. This stems from the facts that; i) Ga is one of the lowest melting point metals in existence, with a melting point of about 30° C., ii) Ga has a high negative electrodeposition potential and thus Ga electrodeposition efficiency is naturally low since high electrodeposition potentials cause hydrogen generation, in addition to Ga deposition, at the cathode surface in aqueous electrolytes, iii) hydrogen bubbles generated on a cathode surface form defects such as un-deposited regions unless such bubbles could immediately be removed from the surface, iv) Ga has a tendency to form low temperature melting alloys with many alloy-partner materials such as In, Cu, Ag, Pb, Sn, etc. Furthermore, such alloys may form during electrodeposition of Ga onto surfaces comprising any of such alloy-partner materials.

Electrodeposition solutions employing glycerol are very viscous and difficult to handle. The viscosity of glycerol at room temperature is 1500 centipoise (cP) compared to the viscosity of water, which is 1 cP. Gas bubbles such as hydrogen bubbles formed on the electroplated (cathode) surface during Ga plating in viscous electrolytes cannot be easily removed from that surface and therefore cause voids and other defects in the electrodeposited films. Such defects may be acceptable for some applications of thick electrodeposited Ga globules. However, they cannot be tolerated in electronic device applications such as solar cell absorber formation applications where they cause compositional non-uniformities, morphological non-uniformities, and pinholes etc., all of which negatively impact the device performance.

Glycerol based plating solutions become more viscous as their temperature is lowered and therefore the problems cited above may get worse at lower temperatures. One other important point about the electrodeposition process for Ga is its sensitivity to the nature of the substrate surface on which the electrodeposition is performed. For example, to form a Cu/In/Ga precursor stack, the Ga film needs to be electrodeposited on an In surface. To form a Cu/Ga/In precursor stack, on the other hand, Ga plating needs to be performed on a Cu surface. One Ga electrodeposition solution that performs well for plating Ga on a Cu surface may not perform well for electrodepositing Ga on an In surface because the electrodeposition efficiency of Ga on one surface may be very different from its electrodeposition efficiency on another surface.

As mentioned above, gallium is a low melting point material with a melting temperature of around 30° C. As a result, when electrodeposited out of aqueous electrodeposition solutions kept at about room temperature (20-25° C.), it often forms rough films comprising molten surface features, especially at high electrodeposition current densities such as current densities greater than about 5 mA/cm$^2$. This is because even though the electrodeposition solution may be at a temperature lower than the melting point of Ga, the local temperature on the cathode surface may actually exceed this melting point due to the heat generated by the electrodeposition current. As further mentioned above, when Ga is electrodeposited on surfaces of materials that easily form alloys with Ga, molten droplets of Ga alloys with low melting temperatures may be formed on such surfaces. If the Ga film is electrodeposited over In and/or Cu, the local heating and Ga melting may actually promote alloying between the plated Ga film and the underlying In and/or Cu because there are low melting alloy phases between Ga and these materials such as In—Ga alloy phases and $CuGa_2$ alloy phase. As a result, the surface roughness of the deposit may further be increased due to the above mentioned reaction and the formation of molten alloy phases. For example, Mehlin et al. (Z. Naturforsch, vol. 49b, p. 1597 (1994)) attributed the rough morphology of their electroplated Ga layers to the alloying of the electrodeposited Ga with the underlying Cu surface of the cathode and the formation of a molten $CuGa_2$ alloy.

Gallium may be electrodeposited from the electrodeposition solution at temperatures below −10° C., preferably below −20° C., most preferably below −30° C., so that local melting of the deposited Ga and its possible reaction with the materials on the cathode surface are avoided. Furthermore, at these low temperatures, the electrodeposition current densities may be increased to levels above 5 $mA/cm^2$, preferably above 10 $mA/cm^2$ and even above 20 $mA/cm^2$ without causing melting and/or alloying on the cathode surface. As a result, the electrodeposition rate and therefore the process throughput may be increased while, at the same time, the deposited film roughness is reduced. All of these benefits are important for the successful use of electrodeposited Ga layers in thin film solar cell manufacturing. For example, the melting point of methanol is −97° C. and the freezing point of a methanol/water mixture is a function of the ratio of methanol to water in the electrodeposition solution. A mixture of 75% methanol and 25% water, for instance, has a freezing point of −82° C. (−115° F.). This means that a Ga plating electrodeposition solution comprising 75% methanol and 25% water may be operated at a temperature as low as about −70-80° C., thus avoiding the melting, reaction and surface roughness problems described above.

The electrodeposition solution may be used to electroplate Ga thin films onto conductive surfaces with a considerably high electrodeposition efficiency of greater than 40%. The electrolyte solution may comprise water and an organic solvent with a room temperature viscosity of less than about 10 cP, preferably less than about 5 cP. Examples of such organic solvents include monohydroxyl alcohols such as methanol, ethanol, and isopropyl alcohol. These organic solvents also have very low freezing points.

As well known in the field of chemistry, an alcohol is defined to be a hydrocarbon derivative in which a hydroxyl group (—OH) is attached to a carbon atom of an alkyl or substituted alkyl group. If the alcohols have two (—OH) groups, such as ethylene glycol and propylene glycol, they are classified as diols or glycols. Glycerol or sugar alcohol has three (—OH) groups and a boiling point of 290° C. Glycols also have boiling points close to 200° C. Therefore, diols containing two (—OH) groups or other organic compounds containing 3 or more (—OH) groups may be useful for high temperature electrodeposition solutions. However, as explained before, such organic compounds have shortcomings including high viscosity giving rise to defectivity in the electrodeposited thin layers. Furthermore, the freezing point of glycerol is too high for the purpose of good quality thin film Ga electrodeposition. The viscosities of ethylene glycol, propylene glycol and diethylene glycol, which are all diols, are 16 cP, 40 cP and 32 cP, respectively. Their freezing points, on the other hand are about −13° C., −59° C. and −10° C., respectively. The viscosity and the freezing point of glycerol, which has three (—OH) groups, are 1500 cP and +18° C., respectively.

The electrodeposition solutions of one embodiment of the present inventions employ at least one monohydroxyl alcohol mixed with water as solvent. Monohydroxyl alcohols contain only one (—OH) or hydroxyl group and they include methanol, primary alcohols (such as ethanol, 1-propanol, isobutanol, 1-pentanol, 1-hexanol, 1-heptanol), secondary alcohols (such as isopropyl alcohol, 2-butanol, 2-methyl-2-butanol, 2-hexanol) and tertiary alcohols (such as tert-butanol, tert-amyl alcohol). The viscosities of monohydroxyl alcohols are typically below 10 cP, mostly below 5 cP, and their freezing points vary from −12° C. for 2-methyl-2-butanol, to −126° C. for 1-propanol. For example, viscosities of methanol, ethanol, 1-propanol, isobutanol, and isopropyl alcohol are 0.59 cP, 1.2 cP, 1.94 cP, 3.95 cP and 1.96 cP, respectively. Their respective freezing points are about −97° C., −114° C., −126° C., −108° C., and −89° C. As can be seen, these low viscosities and extremely low freezing temperatures are very desirable properties for thin Ga film electrodeposition.

The electrodeposition solution may further comprise an acid and/or a salt to control the pH and increase the solution conductivity. The electrodeposition solution may further include a Ga source dissolved in the electrolyte, such as Ga chloride, Ga sulfate, Ga sulfamate, Ga perchloride, Ga phosphate, Ga nitrate, etc. Additional inorganic and organic acids and their alkali metal (lithium (Li), sodium (Na), potassium (K), rubidium (Rb), caesium (Cs), and francium (Fr)) and/or alkali earth metal (beryllium (Be), magnesium (Mg), calcium (Ca), strontium (Sr), barium (Ba) and radium (Ra)) salts can be added to the electrodeposition solution to provide a buffer to stabilize the solution pH and to increase the conductivity of the electrodeposition solution. Concentrations of additional organic or inorganic acids and/or their alkali metal salts may not be high since the Ga salts in the composition also provide some of the ionic conduction. Acids such as sulfamic acid, citric acid, acetic acid, tartaric acid, maleic acid, boric acid, malonic acid, succinic acid, phosphoric acid, oxalic acid, formic acid, arsenic acid, benzoic acid, sulfuric acid, nitric acid, hydrochloric acid, and amino acids, may be used. As stated above, Li, Na, K, Rb, Cs, Be, Mg, Ca, Sr and Ba salts of these acids could be added along with the acid to adjust the pH, provide buffering and increase the electrodeposition solution conductivity. The electrodeposition solution pH range may be acidic or basic, but is preferably between 0 and 7.

The standard potential of Ga electrodeposition from aqueous electrolytes is $E^0_{Ga(III)/Ga}=-0.52$ V. At this potential, the hydrogen evolution is aggressive, especially in an acidic aqueous solution. This is why the Ga electrodeposition processes typically display low electrodeposition efficiencies in aqueous acidic electrodeposition solutions. The mixture of an organic solvent described in embodiments of the inventions reduces the amount of water in the electrodeposition solution and thereby reduces the tendency of hydrogen evolution from water and increases the Ga electrodeposition efficiency. Because of the low viscosity of the present electrodeposition solutions any hydrogen bubbles formed on the cathode surface are easily swept away reducing or eliminating defectivity in the electrodeposited Ga films. The embodiments of the present inventions will now be further described in the following example.

EXAMPLE

To demonstrate the wide range of capabilities of the developed electrodeposition solution chemistries and techniques, the electrodeposition conditions of the Ga layers were widely varied using a factorial design with three factors and three levels. The exemplary solvent was a mixture of methanol and de-ionized water. The Ga source used was $GaCl_3$. Sulfamic acid was used in the electrodeposition solution to increase the ionic conductivity. The three factors that were changed in the experiments were: i) the volume ratios of methanol to water (M/W ratio), ii) the concentration of $GaCl_3$, and, iii) the concentration of the sulfamic acid. The pH was kept in the range of 1.3 and 2. All of the electrodeposition tests were carried out using a current density of 30 mA/cm$^2$ for 150 seconds without stirring the electrodeposition solutions. According to the Faraday's Law, the total charge passed to the cathodes was 4.5 Coulombs/cm$^2$. Therefore, a Ga film thickness of about 1.83 μm was expected if the Ga electrodeposition efficiency were 100%. The anode was a platinum (Pt) mesh. The cathode surface comprised a thin Cu layer. All of the solvent combinations resulted in clear miscible solutions of methanol and water. The thickness of the resultant Ga films was measured to evaluate the electrodeposition efficiencies.

M/W ratio in the present example (or more generally the organic solvent-to-water ratio of the electrodeposition solutions) was found to be an important variable. This ratio may be in the range of about 0.05-99, preferably in the range of about 0.1-10, more preferably in the range of about 0.2-5. The Ga concentration range in the electrolyte is preferably more than 0.1M. The maximum concentration of Ga is determined by the amount of Ga source dissolvable in the solvent with a specific M/W ratio, a typical concentration being in the range of 0.2-0.6M. The sulfamic acid concentration of the present example could be changed from zero to about 0.5M. However, the preferred range of the acid concentration in general is 0.05-0.2M. At higher concentrations of acid, for example over 0.5 M, the Ga electrodeposition efficiency was found to reduce to less than 10%. It should be noted that, within the preferred ranges of the above variables, Ga layers may be electrodeposited at electrodeposition efficiencies greater than 40% using the electrodeposition solutions or electrolytes.

The results of the above experiments may be summarized as follows: i) As the M/W ratio got higher, the electrodeposition efficiency also got higher; ii) as the sulfamic acid concentration became greater than 0.2M, the plating efficiency started to decline, and iii) in general higher Ga concentration in the electrodeposition solution yielded higher electrodeposition efficiencies.

The Ga source in the electrodeposition solution of the embodiments of the present inventions may comprise stock solutions prepared by dissolving Ga metal into their ionic forms as well as by dissolving soluble Ga salts, such as sulfates, chlorides, acetates, sulfamates, carbonates, nitrates, phosphates, oxides, perchlorates, and hydroxides in the solvent of the electrodeposition solution. As mentioned above, the polar organic solvents (monohydroxyl alcohols) are used in the formulation since they need to be miscible with water and dissolve certain amount of Ga salts, acids and their salts. Many primary, secondary or tertiary monohydroxyl alcohols may also be used in place of or in addition to the methanol used in the above example. These alcohols include but are not limited to ethanol, 1-propanol, isobutanol, 1-pentanol, 1-hexanol, 1-heptanol, isopropyl alcohol, 2-butanol, 2-methyl-2-butanol, 2-hexanol, tert-butanol and tert-amyl alcohol. The acids used in the embodiments of the present inventions may cover a wide range including sulfamic acid, acetic acid, citric acid, tartaric acid, maleic acid, boric acid, succinic acid, phosphoric acid, oxalic acid, formic acid, arsenic acid, benzoic acid, sulfuric acid, nitric acid, hydrochloric acid, and amino acids, etc. The concentrations of the acids and their alkali metal and alkali metal earth salts can be adjusted according to the pH requirements of the solutions. The solution pH values can be widely varied between acidic and basic ranges. The preferred range is a pH of 0 to 7. A more preferred range is between 1 and 3. For the pH values larger than 3, some acids with low $pKa_a$, i.e., maleic acid, oxalic acid, and phosphoric acid, may be preferred to both control the solution pH and at the same time complex the $Ga^{3+}$ cations and avoid precipitation of $Ga(OH)_3$.

It should be noted that although the monohydrated alcohols constitute the preferred ingredients in the Ga electrodeposition solutions of embodiments of the present inventions, in certain embodiments some other organic solvents with appropriate viscosity and freezing point values may also be employed. These organic solvents include, but are not limited to acetonitrile (viscosity of about 0.35 cP and freezing point of about −45° C.), acetone (viscosity of about 0.32 cP and freezing point of about −95° C.), formaldehyde (viscosity of about 0.5 cP and freezing point of about −117° C.), and dimethylformimide (viscosity of about 0.9 cP and freezing point of about −61° C.), butyronitrile (viscosity of about 0.55 cP and freezing point of about −112° C.), docholoromethane (viscosity of about 0.41 cP and freezing point of about −97° C.), N-methyl-pyrrolidinone (freezing point of about −23° C.), γ-Butyrolactone (freezing point of about −43° C.), 1-2-Dimethoxy-ethane (viscosity of about 0.5 cP and freezing point of about −69° C.), and tetrahydrofuran (viscosity of about 0.5 cP and freezing point of about −108° C.). It should also be noted that other organic ingredients may also be added to the electrodeposition solution as long as they do not appreciably alter its desired properties described previously. These additional organic ingredients include, but are not limited to diols and alcohols with three (—OH) groups.

Both direct current (DC) and pulsed or variable voltage/current may be utilized during the electrochemical deposition processes in embodiments of the present inventions. The temperature of the electrodeposition solution may be in the range of −120° C. to +30° C. depending upon the nature of the organic solvent, the organic solvent-to-water volume ratio, and the nature of the cathode surface. If the cathode surface comprises materials that alloy easily at low temperature with Ga, then low temperatures such as temperatures in the range of −120° C. to −20° C., may be beneficially selected for the electrodeposition solution.

The electrodeposition solutions of the embodiments of the present inventions may comprise additional ingredients. These include, but are not limited to, grain refiners, surfactants, wetting agents, dopants, other metallic or non-metallic elements etc. For example, organic additives such as surfactants, suppressors, levelers, accelerators and the like may be included in the formulation to refine its grain structure and surface roughness. Organic additives include but are not limited to polyalkylene glycol type polymers, propane sulfonic acids, coumarin, saccharin, furfural, acrylonitrile, magenta dye, glue, SPS, starch, dextrose, and the like.

Although the present inventions are described with respect to certain preferred embodiments herein, modifications thereto will be apparent to those skilled in the art.

We claim:

1. An electrodeposition solution for electrodepositing a gallium (Ga) thin film on a conductive surface, comprising:

water;

at least one organic solvent with a room temperature viscosity of less than or equal to 10 centipoise and a freezing point of lower than −20° C.; and a Ga source material that provides Ga ions, and wherein the electrodeposition solution has a pH between 1 and 3.

2. The electrodeposition solution of claim 1, wherein a volume ratio of the at least one organic solvent to water is in the range of 0.1-10.

3. The electrodeposition solution of claim 2 wherein the at least one organic solvent comprises a monohydroxyl alcohol.

4. The electrodeposition solution of claim 3, wherein the monohydroxyl alcohol comprises at least one of methanol, a primary alcohol, a secondary alcohol and a tertiary alcohol, wherein the primary alcohol is selected from the group consisting of ethanol, 1-propanol, isobutanol, 1-pentanol, 1-hexanol and 1-heptanol, and wherein the secondary alcohol is selected from the group consisting of isopropyl alcohol, 2-butanol, 2-methyl-2-butanol and 2-hexanol, and wherein the tertiary alcohol is selected from the group consisting of tert-butanol and tert-amyl alcohol.

5. The electrodeposition solution of claim 4, further comprising a pH adjustment agent, and wherein the pH adjustment agent comprises at least one of an acid, an alkali metal salt of the acid, and an alkali earth metal salt of the acid, wherein the acid is selected from the group consisting of sulfamic acid, citric acid, acetic acid, tartaric acid, maleic acid, boric acid, malonic acid, succinic acid, phosphoric acid, oxalic acid, formic acid, arsenic acid, benzoic acid, sulfuric acid, nitric acid, hydrochloric acid, and amino acids, wherein the alkali metal salt is selected from the group consisting of a lithium salt, a sodium salt, a potassium salt, a rubidium salt, and a cesium salt, and wherein the alkali earth metal salt is selected from the group consisting of a beryllium salt, a magnesium salt, a calcium salt, a strontium salt, and a barium salt.

6. The electrodeposition solution of claim 3, wherein the Ga source material comprises at least one of a dissolved Ga metal and a dissolved Ga salt, wherein the dissolved Ga salt is selected from the group consisting of Ga-chloride, Ga-sulfate, Ga-sulfamate, Ga-acetate, Ga-carbonate, Ga-nitrate, Ga-perchlorate, Ga-phosphate, Ga-oxide, and Ga-hydroxide.

7. The electrodeposition solution of claim 1, wherein the Ga source material comprises at least one of a dissolved Ga metal and a dissolved Ga salt, wherein the dissolved Ga salt is selected from the group consisting of Ga-chloride, Ga-sulfate, Ga-sulfamate, Ga-acetate, Ga-carbonate, Ga-nitrate, Ga-perchlorate, Ga-phosphate, Ga-oxide, and Ga-hydroxide.

8. The electrodeposition solution of claim 1 further comprising an organic additive, where the organic additive is selected from the group consisting of surfactants, suppressors, levelers, and accelerators.

9. A method of electrodepositing gallium (Ga) for manufacturing a solar cell absorber, comprising the steps of:

providing an electrodeposition solution that comprises water, an organic solvent with a room temperature viscosity of less than or equal to 10 centipoise and a freezing point of lower than −20° C., and a Ga source material that provides Ga ions, wherein the electrodeposition solution has a pH between 1 and 3;

contacting the electrodeposition solution with an electrode and a conductive layer;

establishing a potential difference between the electrode and the conductive layer; and electrodepositing a Ga layer over the conductive layer to assist in obtaining the solar cell absorber.

10. The method of claim 9, wherein a volume ratio of the organic solvent to water is in the range of 0.05-99.

11. The method of claim 10, wherein the organic solvent is a monohydroxyl alcohol.

12. The method of claim 11, wherein the monohydroxyl alcohol is selected from the group consisting of methanol, a primary alcohol, a secondary alcohol and a tertiary alcohol, wherein the primary alcohol is selected from the group consisting of ethanol, 1-propanol, isobutanol, 1-pentanol, 1-hexanol and 1-heptanol, and wherein the secondary alcohol is selected from the group consisting of isopropyl alcohol, 2-butanol, 2-methyl-2-butanol and 2-hexanol, and wherein the tertiary alcohol is selected from the group consisting of tert-butanol and tert-amyl alcohol.

13. The method of claim 9, wherein the Ga source material comprises at least one of a dissolved Ga metal and a dissolved Ga salt, wherein the dissolved Ga salt is selected from the group consisting of Ga-chloride, Ga-sulfate, Ga-sulfamate, Ga-acetate, Ga-carbonate, Ga-nitrate, Ga-perchlorate, Ga-phosphate, Ga-oxide, and Ga-hydroxide.

14. The method of claim 9, further comprising a pH adjustment agent, and wherein the pH adjustment agent comprises at least one of an acid and an alkali metal salt of the acid wherein the acid is selected from the group consisting of sulfamic acid, citric acid, acetic acid, tartaric acid, maleic acid, boric acid, malonic acid, succinic acid, phosphoric acid, oxalic acid, formic acid, arsenic acid, benzoic acid, sulfuric acid, nitric acid, hydrochloric acid, and amino acids and wherein the alkali metal salt is selected from the group consisting of lithium salt, sodium salt, potassium salt, rubidium salt, and a cesium salt.

15. The method of claim 9, wherein the potential difference between the electrode and the conductive layer is established in a pulsing manner.

16. The method of claim 9, wherein the conductive layer is a copper layer formed over a base layer.

17. The method of claim 16, further comprising depositing an indium layer over the gallium layer.

18. The method of claim 17, further comprising reacting the copper, gallium, and indium layers in presence of at least one of selenium and sulfur to form a CIGS(S) solar cell absorber.

* * * * *